US011289040B2

(12) United States Patent
Wu

(10) Patent No.: US 11,289,040 B2
(45) Date of Patent: Mar. 29, 2022

(54) DRIVING CIRCUIT AND DRIVING METHOD OF LIQUID CRYSTAL DISPLAY

(71) Applicant: TCL China Star Optoelectronics Technology Co., Ltd., Shenzhen (CN)

(72) Inventor: Miaofa Wu, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 204 days.

(21) Appl. No.: 16/626,346

(22) PCT Filed: Dec. 13, 2019

(86) PCT No.: PCT/CN2019/125134

§ 371 (c)(1),
(2) Date: Dec. 24, 2019

(87) PCT Pub. No.: WO2021/103180

PCT Pub. Date: Jun. 3, 2021

(65) Prior Publication Data

US 2021/0335300 A1 Oct. 28, 2021

(30) Foreign Application Priority Data

Nov. 28, 2019 (CN) ..... 201911187281.5

(51) Int. Cl.
*G09G 3/36* (2006.01)

(52) U.S. Cl.
CPC ..... *G09G 3/3648* (2013.01); *G09G 2310/061* (2013.01); *G09G 2310/08* (2013.01)

(58) Field of Classification Search
CPC ..... G09G 3/3648; G09G 2310/061; G09G 2310/08; G09G 3/36
See application file for complete search history.

(56) References Cited

U.S. PATENT DOCUMENTS

| | | | | |
|---|---|---|---|---|
| 9,743,499 | B2 * | 8/2017 | Zhang | G09G 3/3426 |
| 10,636,345 | B2 * | 4/2020 | Jia | G09G 3/3225 |
| 2004/0119667 | A1 * | 6/2004 | Yang | G06F 3/1475 345/82 |
| 2004/0228152 | A1 * | 11/2004 | Solie | H02M 1/36 363/49 |
| 2009/0097180 | A1 | 4/2009 | Feng | |
| 2013/0069553 | A1 | 3/2013 | Lin et al. | |
| 2013/0147360 | A1 * | 6/2013 | Kang | H05B 45/37 315/122 |

(Continued)

FOREIGN PATENT DOCUMENTS

| | | |
|---|---|---|
| CN | 101211030 | 7/2008 |
| CN | 101399008 | 4/2009 |

(Continued)

*Primary Examiner* — Jeff Piziali

(57) ABSTRACT

A driving circuit and a driving method of a liquid crystal display are provided. By controlling a reset signal of a timing controller through a switching transistor, a GOA signal is recovered when reading compensation parameters is completed, and the GOA signal is turned off when the reset signal is restarted. Therefore, the timing controller is not affected by the GOA signal output by a pulse width modulator when performing SPI communication with a flash memory. In addition, this reduces communication time, thereby improving speed of optical compensation debugging of a production line.

15 Claims, 2 Drawing Sheets

(56) References Cited

U.S. PATENT DOCUMENTS

| | | | | |
|---|---|---|---|---|
| 2014/0071172 | A1 | 3/2014 | Hussain et al. | |
| 2017/0092204 | A1 | 3/2017 | Kim et al. | |
| 2017/0140888 | A1* | 5/2017 | Cordle | H01F 7/1844 |
| 2017/0148400 | A1* | 5/2017 | Chen | G09G 3/3677 |
| 2018/0374430 | A1* | 12/2018 | Li | G02F 1/133602 |
| 2019/0326806 | A1* | 10/2019 | Gong | H02M 3/33507 |
| 2020/0098302 | A1* | 3/2020 | Jia | G09G 3/2007 |
| 2020/0143860 | A1* | 5/2020 | He | G11C 7/24 |
| 2020/0251056 | A1 | 8/2020 | Huang | |

FOREIGN PATENT DOCUMENTS

| | | | | |
|---|---|---|---|---|
| CN | 101399008 A * | 4/2009 | | G09G 3/34 |
| CN | 101409048 | 4/2009 | | |
| CN | 102354484 | 2/2012 | | |
| CN | 105700210 | 6/2016 | | |
| CN | 106847224 | 6/2017 | | |
| CN | 208806052 | 4/2019 | | |
| CN | 109903713 | 6/2019 | | |

* cited by examiner

DRIVING CIRCUIT AND DRIVING METHOD OF LIQUID CRYSTAL DISPLAY

RELATED APPLICATIONS

This application is a National Phase of PCT Patent Application No. PCT/CN2019/125134 having International filing date of Dec. 13, 2019, which claims the benefit of priority of Chinese Patent Application No. 201911187281.5 filed on Nov. 28, 2019. The contents of the above applications are all incorporated by reference as if fully set forth herein in their entirety.

FIELD AND BACKGROUND OF THE INVENTION

The present disclosure relates to the field of display technologies, and more particularly to a driving circuit and a driving method of a liquid crystal display.

When a display panel is undergoing optical compensation debugging on a production line, a timing controller on a main control board communicates with an adapter board through a serial peripheral interface (SPI). A chip on film (COF) and a flash memory are disposed on the adapter board. Each time, after the timing controller reads and writes Demura compensation data in the flash memory, the timing controller needs to use a reset signal to achieve a highly efficient restart operation. The timing controller has a built-in reset function that triggers a restart action by the reset signal. A three-in-one pulse width modulator continuously detects the reset signal. Once the reset signal is detected, the three-in-one pulse width modulator starts to work and continuously outputs a GOA signal, which interferes with a normal communication of the SPI. For example, a write protection (WP) signal in a SPI signal is 3.3V under normal conditions and is in a state of prohibiting writing and being read only. Distorted by a clock (CK) signal in the GOA signal, resulting in distortion of the SPI signal. At this time, the SPI communication is abnormal, and the timing controller cannot correctly read and write the Demura compensation data on the adapter board.

Therefore, how to effectively improve interference during SPI communication is an important issue in display technology.

SUMMARY OF THE INVENTION

An embodiment of the present application provides a driving circuit and a driving method of a liquid crystal display. By setting a switching transistor and a resistor pull-up pin on a main control board, a reset signal of a timing controller is controlled by the switching transistor, and a GOA signal is restored when reading compensation parameters is completed, and the GOA signal is turned off when the reset signal restarts. This ensures that the timing controller is not affected by the GOA signal output by a pulse width modulator when performing SPI communication with the flash memory, and at the same time reduces communication time, thereby improving speed of optical compensation debugging of a production line.

According to a first aspect of the present application, an embodiment of the present application provides a driving circuit of a liquid crystal display, comprising: a main control board; a switching transistor disposed on the main control board; a timing controller disposed on the main control board and electrically connected to a gate of the switching transistor, wherein the timing controller is configured to obtain a reset signal, read compensation parameters, generate a high-level signal, and transmit the high-level signal to the switching transistor, to cause a drain and a source of the switching transistor to be turned on; a pulse width modulator disposed on the main control board and electrically connected to the drain of the switching transistor, wherein the pulse width modulator is configured to synchronously output a gate driver on array (GOA) signal after the timing controller obtains the reset signal, and the pulse width modulator stops working after the drain and the source of the switching transistor are turned on; an adapter board electrically connected to the main control board through a connector; a chip on film disposed on the adapter board; and a flash memory disposed on the adapter board and electrically connected to the timing controller, wherein the flash memory stores the compensation parameters.

In an embodiment of the present application, the switching transistor comprises a MOS transistor.

In an embodiment of the present application, the timing controller comprises a resistor pull-up pin, after the timing controller reads the compensation parameters in the flash memory, the resistor pull-up pin is configured to generate the high-level signal to control the drain and the source of the switching transistor to be turned on.

In an embodiment of the present application, the pulse width modulator comprises a delay unit configured to restart the pulse width modulator after a preset time.

In an embodiment of the present application, the preset time is calculated according to a data size of the compensation parameters and a transmission rate of a serial peripheral interface.

According to a second aspect of the present application, an embodiment of the present application provides a driving circuit of a liquid crystal display, comprising: a main control board; a switching transistor disposed on the main control board; a timing controller disposed on the main control board and electrically connected to a gate of the switching transistor, wherein the timing controller is configured to obtain a reset signal, read compensation parameters, generate a high-level signal, and transmit the high-level signal to the switching transistor, to cause a drain and a source of the switching transistor to be turned on; and a pulse width modulator disposed on the main control board and electrically connected to the drain of the switching transistor, wherein the pulse width modulator is configured to synchronously output a GOA signal after the timing controller obtains the reset signal, and the pulse width modulator stops working after the drain and the source of the switching transistor are turned on.

In an embodiment of the present application, the driving circuit further comprises: an adapter board electrically connected to the main control board through a connector; a chip on film disposed on the adapter board; and a flash memory disposed on the adapter board and electrically connected to the timing controller.

In an embodiment of the present application, the flash memory stores the compensation parameters.

In an embodiment of the present application, the switching transistor comprises a MOS transistor.

In an embodiment of the present application, the timing controller comprises a resistor pull-up pin, after the timing controller reads the compensation parameters in the flash memory, the resistor pull-up pin is configured to generate the high-level signal to control the drain and the source of the switching transistor to be turned on.

In an embodiment of the present application, the pulse width modulator comprises a delay unit configured to restart the pulse width modulator after a preset time.

In an embodiment of the present application, the preset time is calculated according to a data size of the compensation parameters and a transmission rate of a serial peripheral interface.

According to a third aspect of the present application, an embodiment of the present application provides a driving circuit of a liquid crystal display, comprising steps of: obtaining a reset signal and reading compensation parameters in a flash memory by a timing controller; synchronously outputting a GOA signal by a pulse width modulator after obtaining the reset signal by the timing controller; generating a high-level signal by a resistor pull-up pin of the timing controller after reading the compensation parameters in the flash memory by the timing controller to cause a drain and a source of a switching transistor electrically connected to the timing controller to be turned on; and the pulse width modulator stopping working after turning on the drain and the source of the switching transistor.

In an embodiment of the present application, after the pulse width modulator stops working, after a preset time delay is passed through a delay unit, potential of a chip enable pin of the pulse width modulator is pulled up to restart the pulse width modulator.

In an embodiment of the present application, in a step of stopping the pulse width modulator electrically connected to the switching transistor, the chip enable pin of the pulse width modulator is grounded and stops working.

Beneficial effects of the present application are that: compared to the prior art, in an embodiment of the present application, by setting a switching transistor and a resistor pull-up pin on a main control board, a reset signal of a timing controller is controlled by the switching transistor, and a GOA signal is restored when reading compensation parameters is completed, and the GOA signal is turned off when the reset signal restarts. This ensures that the timing controller is not affected by the GOA signal output by a pulse width modulator when performing SPI communication with the flash memory, and at the same time reduces communication time, thereby improving speed of optical compensation debugging of a production line.

DESCRIPTION OF SPECIFIC EMBODIMENTS OF THE INVENTION

Figure 1:
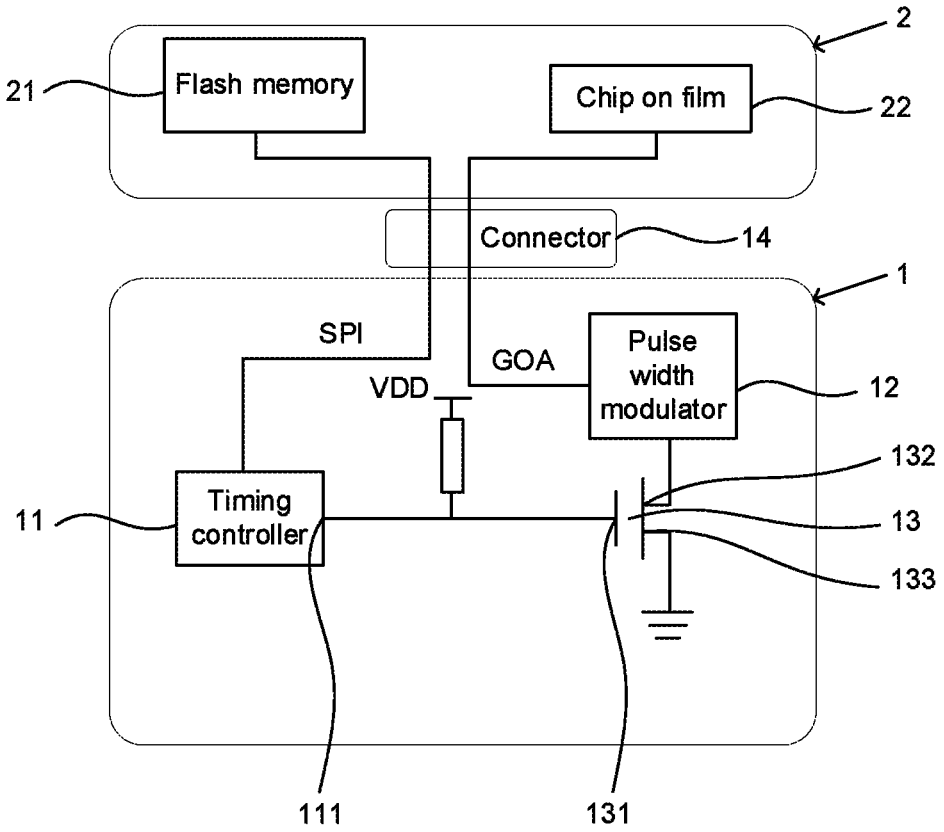
FIG. 1 is a schematic circuit structure diagram of a driving circuit of a liquid crystal display according to an embodiment of the present application.

The technical solutions in the embodiments of the present application will be clearly and completely described below with reference to the accompanying drawings in the embodiments of the present application. Obviously, the described embodiments are only a part of the embodiments of the present application, but not all the embodiments. Based on the embodiments in the present application, all other embodiments obtained by those skilled in the art without creative efforts fall into the protection scope of the present application.

The terms "first", "second", "third", and the like (if present) in the description, claims, and the above-mentioned drawings of the present application are used to distinguish similar objects and are not necessarily used to describe a specific order or in order. It is understood that, the objects so described are interchangeable under appropriate circumstances. Furthermore, the terms "including" and "having" and any of their variations are intended to cover non-exclusive inclusion.

In the detailed description, the drawings and the embodiments discussed below used to describe the principles disclosed in this application are merely for illustration and should not be construed as limiting the scope of this application. Those skilled in the art will understand that the principles of the present application may be implemented in any suitably arranged system. Exemplary embodiments will be described in detail, and examples of the embodiments are shown in the drawings. In addition, a terminal according to an exemplary embodiment will be described in detail with reference to the accompanying drawings. The same reference numbers in the drawings refer to the same elements.

The terminology used in this detailed description is only used to describe a specific embodiment and is not intended to show the concept of the application. Unless the context clearly indicates a different meaning, expressions used in the singular encompass expressions in the plural. In this specification, it is understood that, terms such as "including", "having", and "containing" are intended to indicate the possibility of a feature, number, step, action, or combination thereof disclosed in this specification. It is not intended to exclude the possibility that one or more other features, numbers, steps, actions, or a combination thereof may be present or may be added. The same reference numerals in the drawings refer to the same parts.

As shown in FIG. 1, an embodiment of the present application provides a driving circuit of a liquid crystal display. The driving circuit includes a main control board 1, a timing controller 11, a resistor pull-up pin 111, a pulse width modulator 12, a switching transistor 13, a gate 131, a drain 132, a source 133, a connector 14, an adapter board 2, a flash memory 21, and a chip on film 22.

The timing controller 11 is disposed on the main control board 1 and is electrically connected to the gate 131 of the switching transistor 13. The timing controller 11 is configured to obtain a reset signal, read compensation parameters, and generate a high-level signal to transmit to the switching transistor 13 to cause the drain 132 and the source 133 of the switching transistor 13 to be turned on.

In an embodiment of the present application, the timing controller 11 has a built-in reset function, and a reset operation is implemented by a reset signal issued by the reset function. The flash memory 21 may be, but is not limited to, configured to store compensation parameters. The chip on film 22 includes a gate driving integrated circuit and a source driving integrated circuit configured to optically compensate the display panel according to the compensation parameters.

The timing controller 11 reads and writes the flash memory 21 through SPI. The timing controller 11 further includes a resistor pull-up pin 111. The resistor pull-up pin 111 outputs a low-level signal when the timing controller 11 reads the compensation parameters in the flash memory 21. After the timing controller 11 reads the compensation parameters in the flash memory 21, a high-level signal is generated to control the drain 132 and the source 133 of the switching transistor 13 to be turned on.

The pulse width modulator 12 is disposed on the main control board 1 and is electrically connected to the drain 132 of the switching transistor 13. The pulse width modulator 12 is configured to synchronously output a GOA signal after the timing controller 11 obtains a reset signal. After the drain 132 and the source 133 of the switching transistor 13 are turned on, the pulse width modulator 12 stops working.

In the prior art, because a GOA high-voltage signal output by the pulse width modulator 12 will cause interference to SPI communication. For example, a write protection (WP) signal in a SPI signal is 3.3V under normal conditions and is in a state of prohibiting writing and being read only. Distorted by a clock (CK) signal in the GOA signal, resulting in distortion of the SPI signal. At this time, the SPI communication is abnormal, and the timing controller cannot correctly read and write the Demura compensation data on the adapter board. Therefore, a circuit design of the driving circuit is adopted in an embodiment the present application, so that when the drain 132 and the source 133 of the switching transistor 13 are turned on to control the pulse width modulator 12 to ground and stop working, so as to avoid that the timing controller 11 cannot read and write data of the compensation parameters in the flash memory 21.

Figure 2:
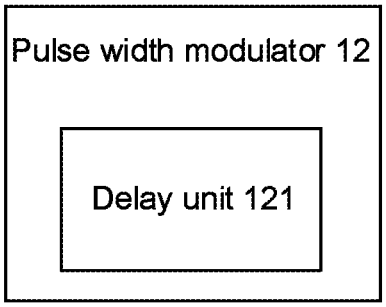
FIG. 2 is a schematic structural diagram of a pulse width modulator according to an embodiment of the present application.

As shown in FIG. 2, the pulse width modulator 12 further includes a delay unit 121 configured to restart the pulse width modulator 12 after a preset time. The preset time is calculated according to a data size of the compensation parameters and a transmission rate of a serial peripheral interface (SPI).

The gate 131 of the switching transistor 13 is electrically connected to the timing controller 11 and a power voltage terminal (VDD), the drain 132 of the switch transistor 13 is electrically connected to the pulse width modulator 12, and the source 133 of the switch transistor is grounded.

In an embodiment of the present application, the switching transistor 13 includes a MOS transistor. The switching transistor 13 controls the reset signal of the timing controller 11. After the timing controller 11 recognizes the reset signal for completing the optical compensation, the timing controller 11 restarts and reads the data of the compensation parameters in the flash memory 21. The resistor pull-up pin 111 of the timing controller 11 generates a high-level signal after the timing controller 11 reads the compensation parameters in the flash memory 21 and makes the drain 132 and the source 133 of the switch transistor 13 to be turned on. As a result, the pulse width modulator 12 is grounded and stops operating. After a preset time has passed by the delay unit 121 in the pulse width modulator 12, a chip enable pin of the pulse width modulator 12 is pulled up, so that the pulse width modulator 12 starts to work again.

The adapter board 2 and the main control board 1 are electrically connected through a connector 14. The chip on film 22 is disposed on the adapter board 2. The flash memory 22 is disposed on the adapter board 2 and is electrically connected to the timing controller 11.

An embodiment of the present application provides a driving circuit of a liquid crystal display. By setting a switching transistor and a resistor pull-up pin on a main control board, a reset signal of a timing controller is controlled by the switching transistor, and a GOA signal is restored when reading compensation parameters is completed, and the GOA signal is turned off when the reset signal restarts. This ensures that the timing controller is not affected by the GOA signal output by a pulse width modulator when performing SPI communication with the flash memory, and at the same time reduces communication time, thereby improving speed of optical compensation debugging of a production line.

Figure 3:
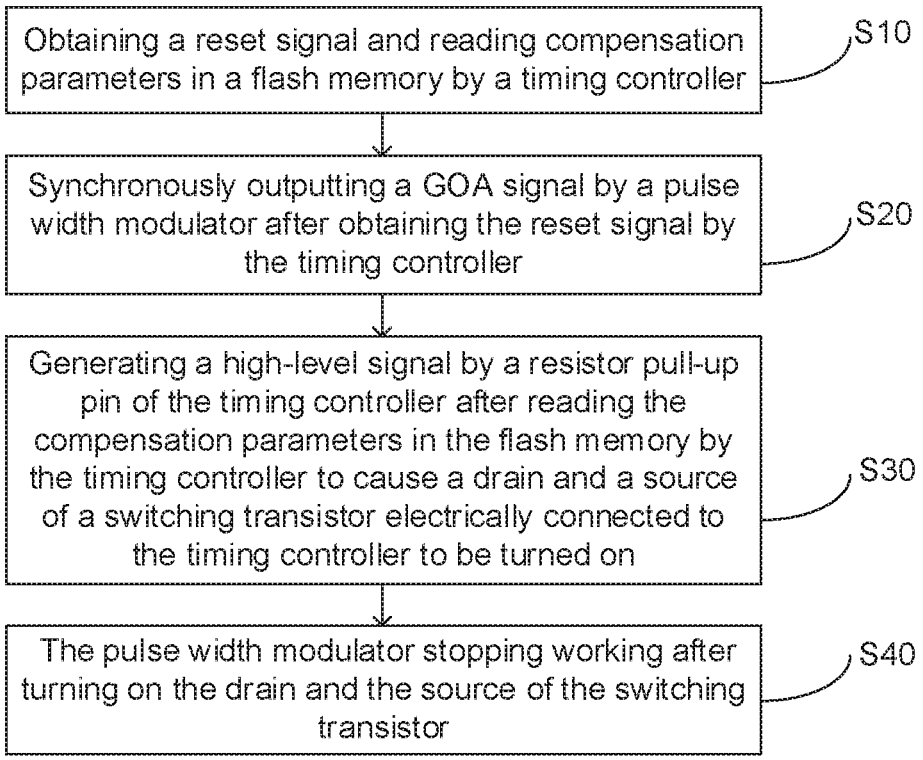
FIG. 3 is a schematic flowchart of steps in a method of driving a liquid crystal display according to an embodiment of the present application.

As shown in FIG. 3, an embodiment of the present application provides a method of driving a liquid crystal display, including the following steps.

Step S10, obtaining a reset signal and reading compensation parameters in a flash memory by a timing controller.

In an embodiment of the present application, the timing controller 11 has a built-in reset function, and reset operation is implemented by a reset signal issued by the reset function. The timing controller 11 reads and writes the flash memory 21 through SPI.

The flash memory 21 may be, but is not limited to, configured to store compensation parameters. The flash memory 21 is disposed on an adapter board 2. The adapter board 2 further includes a chip on film 22, which includes a gate drive integrated circuit and a source drive integrated circuit for optically compensating the display panel according to compensation parameters.

Step S20, synchronously outputting a GOA signal by a pulse width modulator after obtaining the reset signal by the timing controller.

Because a GOA high-voltage signal output by the pulse width modulator 12 will cause interference to SPI communication. For example, a write protection (WP) signal in a SPI signal is 3.3V under normal conditions and is in a state of prohibiting writing and being read only. Distorted by a clock (CK) signal in the GOA signal, resulting in distortion of the SPI signal. At this time, the SPI communication is abnormal, and the timing controller cannot correctly read and write the Demura compensation data on the adapter board. Therefore, a circuit design of the driving circuit is adopted in an embodiment the present application, so that when the drain 132 and the source 133 of the switching transistor 13 are turned on to control the pulse width modulator 12 to ground and stop working, so as to avoid that the timing controller 11 cannot read and write data of the compensation parameters in the flash memory 21.

As shown in FIG. 2, the pulse width modulator 12 further includes a delay unit 121 configured to restart the pulse width modulator 12 after a preset time. The preset time is calculated according to a data size of the compensation parameters and a transmission rate of a serial peripheral interface (SPI).

Step S30, generating a high-level signal by a resistor pull-up pin of the timing controller after reading the compensation parameters in the flash memory by the timing controller to cause a drain and a source of a switching transistor electrically connected to the timing controller to be turned on.

In an embodiment of the present application, the resistor pull-up pin 111 outputs a low-level signal when the timing controller 11 reads the compensation parameters in the flash memory 21. After the timing controller 11 reads the compensation parameters in the flash memory 21, a high-level signal is generated. The gate 131 of the switching transistor 13 is electrically connected to the timing controller 11 and a power voltage terminal (VDD), the drain 132 of the switch transistor 13 is electrically connected to the pulse width modulator 12, and the source 133 of the switch transistor is grounded.

Step S40, the pulse width modulator stopping working after turning on the drain and the source of the switching transistor.

In an embodiment of the present application, after the drain 132 and the source 133 of the switching transistor 13 are turned on, the chip enable pin of the pulse width modulator 12 electrically connected to the switching transistor 13 is grounded to stop working.

An embodiment of the present application provides a method of driving a liquid crystal display. By setting a switching transistor and a resistor pull-up pin on a main control board, a reset signal of a timing controller is controlled by the switching transistor, and a GOA signal is restored when reading compensation parameters is completed, and the GOA signal is turned off when the reset signal restarts. This ensures that the timing controller is not affected by the GOA signal output by a pulse width modulator when performing SPI communication with the flash memory, and at the same time reduces communication time, thereby improving speed of optical compensation debugging of a production line.

A driving circuit and a driving method of a liquid crystal display provided in the embodiments of the present application have been described in detail above. Specific examples are used herein to explain the principles and implementation of the present application. The description of the above embodiments is only used to help understand the method of the present application and its core ideas. In addition, for those skilled in the art, according to the idea of the present application, there will be changes in the specific implementation and application scope. In summary, the content of this specification should not be construed as a limitation on the present application.

What is claimed is:

1. A driving circuit of a liquid crystal display, comprising:
a main control board;
a switching transistor disposed on the main control board;
a timing controller disposed on the main control board and electrically connected to a gate of the switching transistor, wherein the timing controller is configured to obtain a reset signal, read compensation parameters, generate a signal, and transmit the signal to the switching transistor, to cause a drain and a source of the switching transistor to be turned on;
a pulse width modulator disposed on the main control board and electrically connected to the drain of the switching transistor, wherein the pulse width modulator is configured to synchronously output a gate driver on array (GOA) signal after the timing controller obtains the reset signal, and the pulse width modulator stops working after the drain and the source of the switching transistor are turned on;
an adapter board electrically connected to the main control board through a connector;
a chip on film disposed on the adapter board; and
a flash memory disposed on the adapter board and electrically connected to the timing controller, wherein the flash memory stores the compensation parameters;
wherein when the drain and the source of the switching transistor are turned on to control the pulse width modulator to ground and stop working, the timing controller reads and writes data of the compensation parameters in the flash memory.

2. The driving circuit according to claim 1, wherein the switching transistor comprises a MOS transistor.

3. The driving circuit according to claim 1, wherein the timing controller comprises a resistor pull-up pin, after the timing controller reads the compensation parameters in the flash memory, the resistor pull-up pin is configured to generate the signal to control the drain and the source of the switching transistor to be turned on.

4. The driving circuit according to claim 1, wherein the pulse width modulator comprises a delay timer configured to restart the pulse width modulator after a preset time.

5. The driving circuit according to claim 4, wherein the preset time is calculated according to a data size of the compensation parameters and a transmission rate of a serial peripheral interface.

6. A driving circuit of a liquid crystal display, comprising:
a main control board;
a switching transistor disposed on the main control board;
a timing controller disposed on the main control board and electrically connected to a gate of the switching transistor, wherein the timing controller is configured to obtain a reset signal, read compensation parameters, generate a signal, and transmit the signal to the switching transistor, to cause a drain and a source of the switching transistor to be turned on; and
a pulse width modulator disposed on the main control board and electrically connected to the drain of the switching transistor, wherein the pulse width modulator is configured to synchronously output a GOA signal after the timing controller obtains the reset signal, and the pulse width modulator stops working after the drain and the source of the switching transistor are turned on; and
a flash memory electrically connected to the timing controller, wherein the flash memory stores the compensation parameters;
wherein when the drain and the source of the switching transistor are turned on to control the pulse width modulator to ground and stop working, the timing controller reads and writes data of the compensation parameters in the flash memory.

7. The driving circuit according to claim 6, further comprising:
an adapter board electrically connected to the main control board through a connector;
a chip on film disposed on the adapter board.

8. The driving circuit according to claim 7, wherein the flash memory stores the compensation parameters.

9. The driving circuit according to claim 6, wherein the switching transistor comprises a MOS transistor.

10. The driving circuit according to claim 6, wherein the timing controller comprises a resistor pull-up pin, after the timing controller reads the compensation parameters in the flash memory, the resistor pull-up pin is configured to generate the signal to control the drain and the source of the switching transistor to be turned on.

11. The driving circuit according to claim 6, wherein the pulse width modulator comprises a delay timer configured to restart the pulse width modulator after a preset time.

12. The driving circuit according to claim 11, wherein the preset time is calculated according to a data size of the compensation parameters and a transmission rate of a serial peripheral interface.

13. A driving method of a liquid crystal display, comprising steps of:
obtaining a reset signal and reading compensation parameters in a flash memory by a timing controller;
synchronously outputting a GOA signal by a pulse width modulator after obtaining the reset signal by the timing controller;
generating a signal by a resistor pull-up pin of the timing controller after reading the compensation parameters in the flash memory by the timing controller to cause a drain and a source of a switching transistor electrically connected to the timing controller to be turned on; and the pulse width modulator stopping working after turning on the drain and the source of the switching transistor;

wherein when the drain and the source of the switching transistor are turned on to control the pulse width modulator to ground and stop working, the timing controller reads and writes data of the compensation parameters in the flash memory.

14. The driving circuit according to claim 13, wherein after the pulse width modulator stops working, after a preset time delay is passed through a delay timer, potential of a chip enable pin of the pulse width modulator is pulled up to restart the pulse width modulator.

15. The driving circuit according to claim 13, wherein in a step of stopping the pulse width modulator electrically connected to the switching transistor, a chip enable pin of the pulse width modulator is grounded and stops working.

* * * * *